US006090182A

United States Patent [19]

Riley

[11] Patent Number: 6,090,182

[45] **Date of Patent: *Jul. 18, 2000**

[54] HOT OXYGEN BLAST FURNACE INJECTION SYSTEM

[75] Inventor: Michael Francis Riley, Danbury, Conn.

[73] Assignee: Praxair Technology, Inc., Danbury, Conn.

[ * ] Notice: This patent issued on a continued prosecution application filed under 37 CFR 1.53(d), and is subject to the twenty year patent term provisions of 35 U.S.C. 154(a)(2).

[21] Appl. No.: 08/959,841

[22] Filed: Oct. 29, 1997

[51] Int. Cl.[7] ..... C21B 7/16

[52] U.S. Cl. ..... 75/460; 75/466; 266/267

[58] Field of Search ..... 75/458, 460, 466; 266/265, 267, 225

[56] References Cited

U.S. PATENT DOCUMENTS

| | | | |
|---|---|---|---|
| 4,917,727 | 4/1990 | Saito et al. | 75/460 |
| 4,985,075 | 1/1991 | Ohno et al. | 75/466 |
| 5,266,024 | 11/1993 | Anderson | 431/11 |
| 5,451,034 | 9/1995 | Ulveiling et al. | 266/267 |
| 5,522,916 | 6/1996 | Karinthi et al. | 75/414 |
| 5,582,036 | 12/1996 | Drnevich et al. | 62/656 |

FOREIGN PATENT DOCUMENTS 576869 1/1994 European Pat. Off. .

OTHER PUBLICATIONS

Campbell et al., "Oxy–coal injection at Cleveland Ironworks", Iron and Steelmaking, pp 120–125, vol. 19 (Dec. 1992).

*Primary Examiner*—Scott Kastler
*Attorney, Agent, or Firm*—Stanley Ktorides

[57] ABSTRACT

A method for providing a blast stream into a blast furnace wherein fuel and hot oxygen are provided into the blast air, the hot oxygen being at a temperature and velocity each greater than that of the blast air, and wherein the fuel and hot oxygen begin to combust prior to passage into the blast furnace in the blast stream.

6 Claims, 3 Drawing Sheets

HOT OXYGEN BLAST FURNACE INJECTION SYSTEM

TECHNICAL FIELD

This invention relates generally to the operation of blast furnaces and, more particularly, to the operation of blast furnaces wherein oxygen is added to the blast air stream.

BACKGROUND ART

Blast furnaces are the primary source of high-purity iron for steelmaking. High-purity iron is required for the manufacture of the highest quality steels which must have minimal levels of detrimental elements, like copper, which are difficult to remove chemically from steel. Blast furnaces are also used in the production of other metals such as ferromanganese and lead.

Traditionally, metallurgical coke has been the primary fuel and the source of the reducing gas consumed in the blast furnace process. Coke, fluxes and ore, such as iron ore, are charged in layers at the top of the furnace, and a hot air blast is blown into the bottom of the furnace. The air reacts with the coke, generating heat for the process and producing a reducing gas which preheats the coke, fluxes and ore, and converts the iron ore to iron as it flows up through the furnace. The gas exits the top of the furnace and is used in part as a fuel to preheat the air blast.

Metallurgical coke is formed by heating coal in the absence of air, driving off the more volatile components of coal. Many of these volatile components are environmental and health hazards, and cokemaking in recent years has become increasingly regulated. The cost of complying with these regulations has raised cokemaking operating costs and increased the capital required for new cokemaking facilities. As a result, the supply of coke is shrinking and prices are rising. These factors have led blast furnace operators to decrease the amount of coke they use and to inject large amounts of alternate fossil fuels into the hot air blast supply to the furnace as a substitute. The most common fossil fuels injected are pulverized coal, granular coal, and natural gas. Pulverized and granular coal are preferred for economic reasons.

Coke is preheated by the reducing gas as the gas flows up the furnace. In contrast, the alternate fossil fuels are injected at ambient temperature. Accordingly, the addition of such fuels into the blast air supply adds a thermal load to the furnace which does not occur when only coke is used as the fuel. Operators of blast furnaces have addressed this problem by adding oxygen to the blast air and this has provided some benefit. However, even with oxygen addition, blast furnace operation at higher fossil fuel injection levels has not been achievable because of blast furnace operating problems related to poor or incomplete combustion of injected fossil fuels.

Accordingly it is an object of this invention to provide a method for providing blast air with fuel and oxygen for subsequent passage into a blast furnace which will enable improved operation of the blast furnace.

SUMMARY OF THE INVENTION

The above and other objects which will become apparent to those skilled in the art upon a reading of this disclosure are attained by the present invention which is:

A method for providing a blast stream into a blast furnace comprising:

(A) establishing a blast air stream having a blast air velocity and a blast air temperature;

(B) passing fuel into the blast air stream;

(C) injecting a jet of oxygen into the blast air stream having a velocity which exceeds the blast air velocity and having a temperature which exceeds the blast air temperature;

(D) combusting fuel with oxygen within the blast air stream to create a hot blast stream; and (E) passing the hot blast stream into a blast furnace.

As used herein the term "oxygen" means a fluid having an oxygen concentration of at least 50 mole percent.

As used herein the term "blast furnace" means a tall shaft-type furnace with a vertical stack superimposed over a crucible-like hearth used to reduce oxides to molten metal.

DETAILED DESCRIPTION

The invention provides enhanced ignition and combustion conditions for the fuel by creating a zone of high temperature and high oxygen concentration within the blast air stream. The invention will be described in detail with reference to the Drawings.

Figure 1:
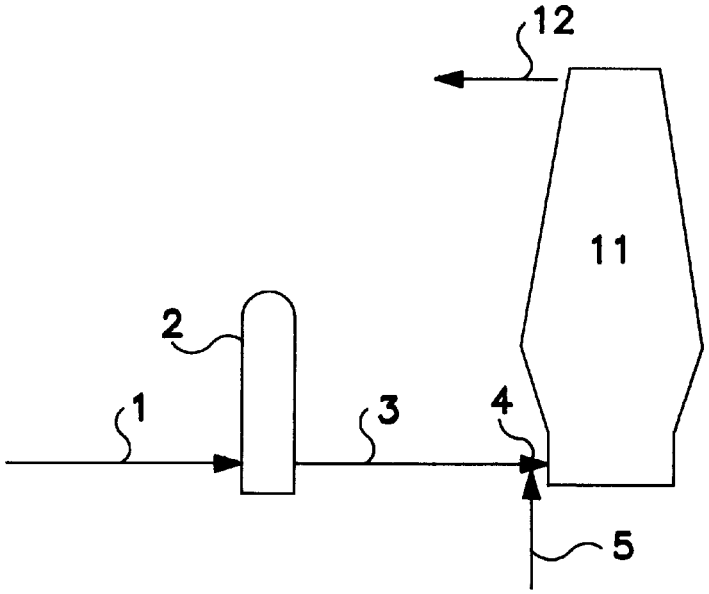
FIG. 1 is a simplified schematic representation of a system wherein the method of the invention may be practiced.

Referring now to FIG. 1, ambient air 1 is heated by passage through heater 2 and exits therefrom as blast air stream 3 having a velocity generally within the range of from 125 to 275 meters per second (mps) and a temperature generally within the range of from 870 to 1320° C. The blast air stream travels within a blowpipe which communicates with a tuyere within the sidewall of a blast furnace.

Fuel 4 is added into the blast air stream either within the blowpipe or the tuyere. The fuel may be any effective fuel which will combust with oxygen. Among such fuels one can name coal, such as pulverized, granulated or powdered coal, natural gas and coke oven gas. The preferred fuels are pulverized, granulated coal or powdered coal.

Oxygen jet 5 is injected into the blast air stream either within the blowpipe or the tuyere. The oxygen jet has an oxygen concentration of at least 50 mole percent and may have an oxygen concentration of 85 mole percent or more. The oxygen jet has a velocity which exceeds that of the blast air stream 3 and preferably has a velocity which is at least 1.5 times that of the blast air stream. The velocity of the oxygen jet is generally within the range of from 350 to 850 mps. Preferably the velocity of the oxygen jet is at least one-half of sonic velocity. Sonic velocity, for example, is about 780 mps at 1370° C. and is about 850 mps at 1650° C. The oxygen jet has a temperature which exceeds that of the blast air stream 3 and is generally within the range of from 1200 to 1650° C. Any suitable means for establishing the defined hot oxygen jet of this invention may be used. A particularly preferred method for generating the defined hot oxygen jet of this invention is the method disclosed in U.S. Pat. No. 5,266,024—Anderson.

Figure 2:
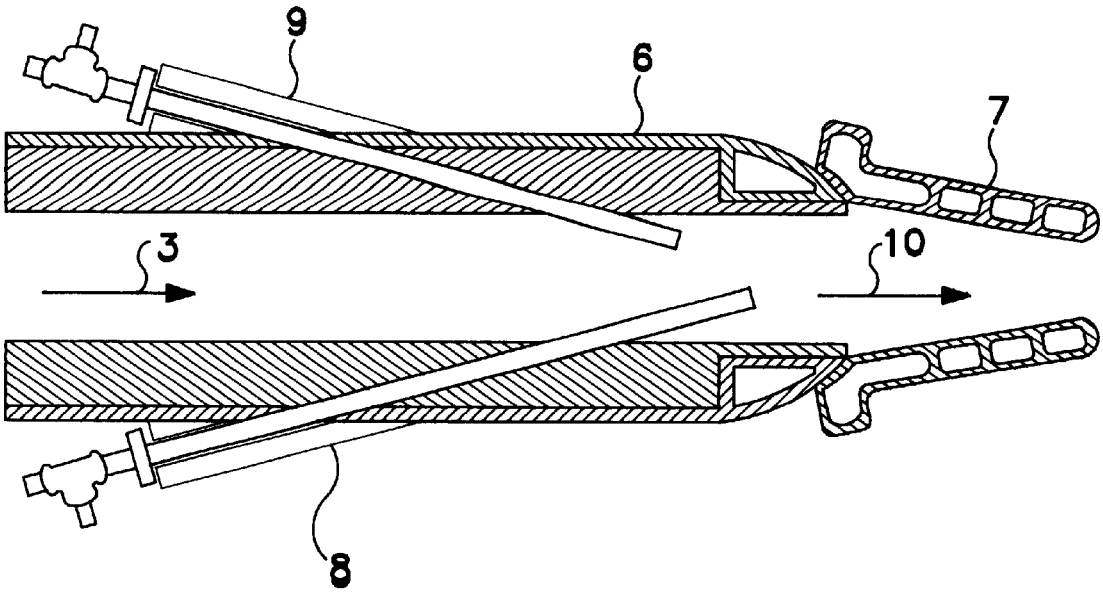
FIG. 2 is a more detailed cross-sectional representation of a preferred system for the provision of fuel and oxygen into the blast air stream upstream of the blast furnace.

FIG. 2 illustrates in greater detail one embodiment of the provision of fuel and hot oxygen into the blast air stream. Referring now to FIG. 2, blast air stream 3 is flowing within blowpipe 6 which communicates with tuyere 7 within the sidewall of a blast furnace. In practice there may be a plurality of tuyeres around the periphery of a blast furnace and in such cases one or more of such tuyeres may pass a blast stream generated by the practice of this invention into the blast furnace. Fuel, e.g. pulverized, powdered or granulated coal, is provided into blast air stream 3 within blowpipe 6 through fuel lance 8, and hot oxygen is provided into blast air stream 3 within blowpipe 6 through hot oxygen lance 9.

The high velocity and thus the high momentum of the hot oxygen jet creates a strong mixing action which mixes or entrains the fuel into the jet. Moreover, the high temperature of the oxygen jet rapidly devolatilizes the fuel when the fuel contains volatiles. Because of the high temperature of the hot oxygen jet, substantially no additional mixing with the blast air stream is necessary to initiate combustion of the fuel. In contrast, if the oxygen jet were to be injected at ambient or near-ambient temperature, mixing with the blast air would be needed to provide sufficient heat to ignite the fuel. This mixing with the blast air would lower the oxygen concentration in the oxygen jet, which is detrimental to ignition and combustion. Thus, the present invention efficiently uses the injected oxygen for enhanced combustion by creating conditions under which ignition can occur at higher local oxygen conditions. The method of this invention alleviates the operating problems related to poor or incomplete combustion of the injected fuel which has led to fossil fuel injection rate limitations in conventional blast furnace operations.

Preferably the hot oxygen lance penetrates through the wall of the blowpipe at an angle equal or similar to the angle of the fuel lance, and the tip of the hot oxygen lance is positioned so that the oxygen jet intersects the injected fuel stream as close to the tip of the fuel lance as practical. The distance between the tips of the two lances can vary between about 5 and 50 times the hot oxygen outlet nozzle diameter which defines the initial diameter of the oxygen jet. Closer distances provide higher momentum transfer for mixing but could lead to overheating of the fuel lance. Greater distances may result in excessive dilution and cooling of the hot oxygen stream by the air blast. However, within the range of distances, the hot oxygen lance tip could be positioned flush with the blowpipe wall, offering protection against the air blast and potentially extending lance life. Because of its high velocity and high momentum, the hot oxygen jet will be able to penetrate across the blast air stream and mix with the injected fuel.

The combustion of the fuel with the hot oxygen within the blast air stream creates a hot blast stream 10. Referring back now to FIG. 1, this hot blast stream 10 is passed into blast furnace 11 and is used to generate heat and reducing gas within the blast furnace. Exhaust gas is removed from blast furnace 11 in exhaust stream 12.

The following examples are offered to further illustrate the invention or to provide a comparison to demonstrate the advantages of the invention. They are not intended to be limiting.

Figure 3:
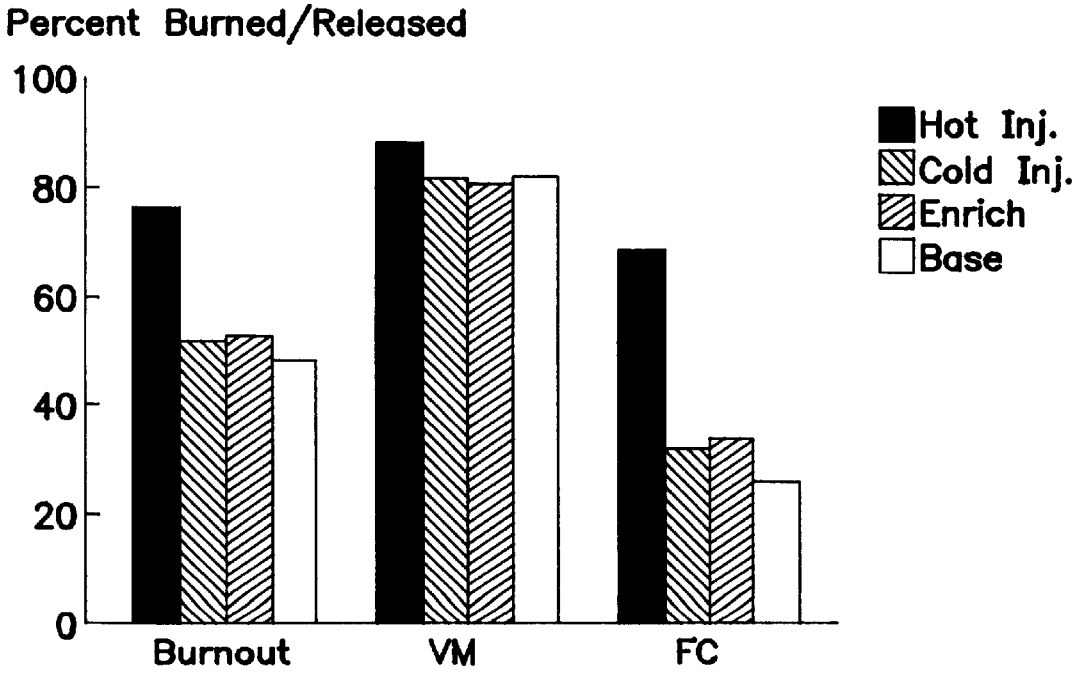
FIGS. 3, 4 and 5 are graphical representations of results obtained with the practice of this invention and, for comparative purposes, of results obtained with conventional practices.
Figure 4:
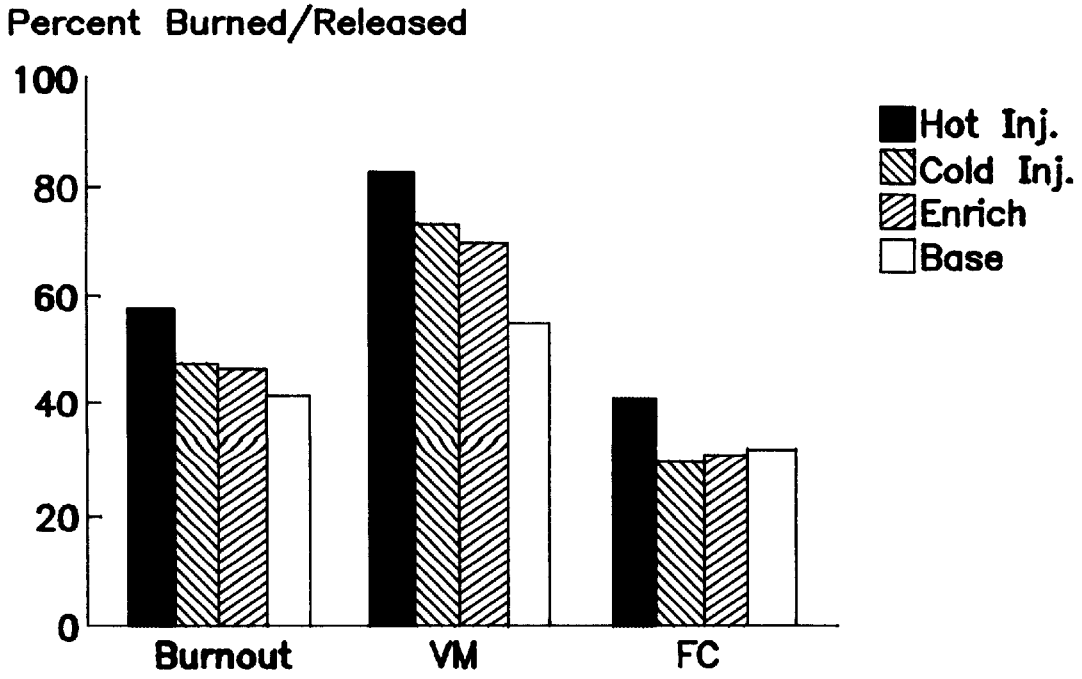

FIGS. 3 and 4 illustrate in graphical form the results of total burnout, volatile release (VM) and fixed carbon burnout (FC) for four cases studied in a pilot-scale blowpipe: (1) Base, wherein no oxygen is provided to the blast air stream, (2) Enrich, wherein oxygen is provided at ambient temperature upstream of the blast air heater, (3) Cold Inj., wherein oxygen is provided into the blast air stream similarly as shown in FIG. 2 but at ambient temperature, and (4) Hot Inj., wherein the method of this invention was employed in a manner similar to that illustrated in FIG. 2. In each case the blast air stream had a blast air velocity of 160 mps and a blast air temperature of 900° C. The fuel was high volatile pulverized coal of the kind typically used in commercial blast furnace operations and having the analysis shown in Table 1. The fuel was provided into the blast air stream at two flowrates, 7.5 kilograms per hour (kg/hr) with the results shown in FIG. 3, and 9.5 kg/hr with the results shown in FIG. 4.

TABLE 1

| Coal Analysis | | | |
|---|---|---|---|
| Proximate Analysis | Weight Percent | Ultimate Analysis | Weight Percent |
| Moisture | 1.19 | Carbon | 77.5 |
| Ash | 7.13 | Hydrogen | 5.1 |
| Volatile Matter | 34.94 | Nitrogen | 1.4 |
| Fixed Carbon | 56.75 | Sulfur | 1.0 |
| | | Oxygen | 6.7 |

Char was collected by quenching with water 0.75 m downstream of the coal injection point. The fraction of total coal burnout, T, was determined by chemical analysis of the ash content of the original coal, $A_0$, and the ash content of the collected char, $A_1$, according to the relation $$T = \frac{(A_1 - A_o)}{A_1(1 - A_o)}$$

The release of volatiles, R, and the combustion of fixed carbon, C, were determined from the chemical analyses of ash, volatile matter ($V_0$) and fixed carbon ($F_0$) in the coal, and ash, volatile matter ($V_1$), and fixed carbon ($F_1$) in the char, according to the relations $$R = 1 - \frac{V_1 A_o}{V_o A_1}$$

$$C = 1 - \frac{F_1 A_o}{F_o A_1}$$

When oxygen was used, 3.7 $Nm^3$/hr of the air flow was replaced with oxygen. For the enrichment test, the air and oxygen were mixed at ambient temperature and the mixture heated to 900° C., so that the total gas flow rate, velocity and temperature were the same as the base case. For the ambient injection test, 93.7 $Nm^3$/hr of air was used for the blast at 900° C., and 3.7 $Nm^3$/hr of oxygen was injected through the oxygen lance. The total gas flow rate was the same as in the base case, while the temperature was lower since the oxygen addition was not heated. The nozzle velocity of the ambient oxygen was about 60 mps, or 0.375 times the blast air velocity. The oxygen for the ambient injection test had a purity of about 99.99 percent. For the hot injection test, the conditions were the same except that the oxygen was generated using the method disclosed in U.S. Pat. No. 5,266,024—Anderson and passed into the blast air stream from the hot oxygen lance to provide hot oxygen at 1565° C. with a velocity of about 375 mps, or 2.34 times the blast air velocity. In this case the oxygen had an oxygen concentration of about 80 mole percent.

FIGS. 3 and 4 compare the total burnout, volatile release, and fixed carbon burnout for each case for coal injection rates of 7.5 kg/hr and 9.5 kg/hr, respectively. As can be seen from the results reported in FIGS. 3 and 4, the use of hot oxygen consistently shows higher performance in each category. In fact, the total burnout at 9.5 kg/hr coal injection rate with the hot oxygen is higher than in any of the other cases at 7.5 kg/hr, indicating the ability to successfully inject higher coal rates with the use of hot oxygen.

Figure 5:
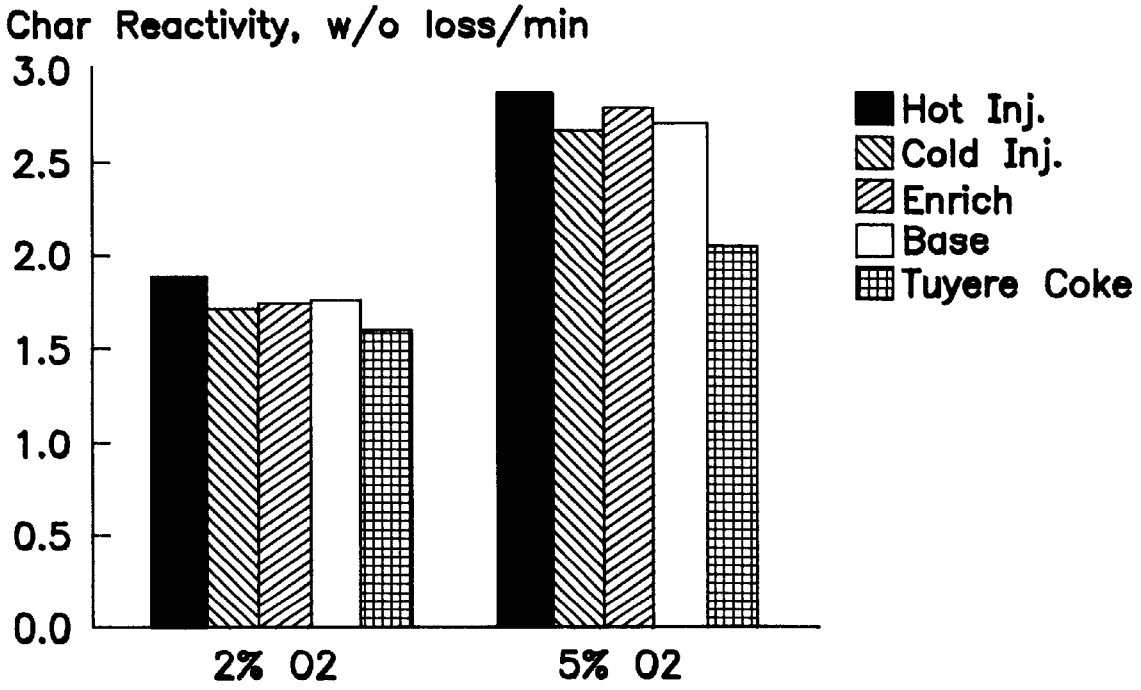

Any char which does not burn in the blowpipe/tuyere enters the furnace and burns in competition with coke. If the char is not sufficiently reactive, it can escape up the furnace to plug the ore/coke bed. Additional tests were conducted on the collected char to quantify its reactivity under furnace conditions. Char samples were reacted at 1700° C. in a thermogravimetric analyzer under atmospheres containing 2% oxygen and 5% oxygen, with the balance being nitrogen containing 10% carbon dioxide. The reactivity was measured by the rate of weight loss of the char. FIG. 5 shows the results for char collected from each case and from a test on blast furnace tuyere coke samples. All char samples were more reactive than tuyere coke, indicating that they will burn preferentially to coke and so are unlikely to escape and cause plugging. The char generated with the use of the hot oxygen is the most reactive, giving the invention with the use of hot oxygen a further advantage over conventional oxygen use routes in blast furnace operations.

Although the invention has been described in detail with reference to certain preferred embodiments, those skilled in the art will recognize that there are other embodiments of the invention within the spirit and the scope of the claims.

What is claimed is:

1. A method for providing a blast stream into a blast furnace comprising:

(A) establishing a blast air stream having a blast air velocity and a blast air temperature;

(B) passing fuel into the blast air stream;

(C) injecting a jet of oxygen into the blast air stream having a velocity which exceeds the blast air velocity and having a temperature which exceeds the blast air temperature to create a zone of high temperature and high oxygen concentration within the blast air stream;

(D) entraining fuel into the jet of oxygen within said zone of high temperature and high oxygen concentration, initiating combustion of the fuel with the oxygen without any mixing with the blast air stream, and combusting fuel with the oxygen to create a hot blast stream; and (E) passing the hot blast stream into a blast furnace.

2. The method of claim 1 wherein the fuel comprises coal.

3. The method of claim 1 wherein the temperature of the oxygen injected into the blast air stream is within the range of from 1200 to 1650° C.

4. The method of claim 1 wherein the velocity of the oxygen injected into the blast air stream is at least one-half of sonic velocity.

5. The method of claim 3 wherein the velocity of the oxygen injected into the blast air stream is at least 1.5 times the blast air velocity.

6. The method of claim 1 wherein the jet of oxygen has an initial diameter when injected into the blast air stream and the jet of oxygen is injected into the blast air stream at a distance, within the range of from 5 to 50 times said initial diameter, from where the fuel is passed into the blast air stream.

* * * * *